US011963589B2

(12) United States Patent
Riotte

(10) Patent No.: US 11,963,589 B2
(45) Date of Patent: Apr. 23, 2024

(54) LOCKING DEVICE FOR A WRISTLET CLASP

(71) Applicant: ROLEX SA, Geneva (CH)

(72) Inventor: Thibaut Riotte, Metz-Tessy (FR)

(73) Assignee: ROLEX SA, Geneva (CH)

( * ) Notice: Subject to any disclaimer, the term of this patent is extended or adjusted under 35 U.S.C. 154(b) by 277 days.

(21) Appl. No.: 17/343,926

(22) Filed: Jun. 10, 2021

(65) Prior Publication Data

US 2021/0393004 A1 Dec. 23, 2021

(30) Foreign Application Priority Data

Jun. 23, 2020 (EP) ..... 20181588

(51) Int. Cl.
*A44C 5/22* (2006.01)
*A44C 5/24* (2006.01)

(52) U.S. Cl.
CPC ..... *A44C 5/24* (2013.01)

(58) Field of Classification Search
CPC ..... A44C 5/24; A44C 5/243; A44C 5/22
See application file for complete search history.

(56) References Cited

U.S. PATENT DOCUMENTS 6,434,798 B1 * 8/2002 Yamakawa ..... A44C 5/24 24/71 J
7,124,478 B2 10/2006 Aquillon et al.
8,001,658 B2 * 8/2011 Christian ..... A44C 5/246 24/71 J
9,282,792 B2 * 3/2016 Mace ..... A44C 5/24
9,635,911 B2 * 5/2017 Moille ..... A44C 5/24
10,791,806 B2 * 10/2020 Cusin ..... A44C 5/2042
2006/0090305 A1 5/2006 Aquillon et al.
2012/0240360 A1 9/2012 Catanese

FOREIGN PATENT DOCUMENTS

EP 1654950 A1 5/2006
EP 2502516 A1 9/2012

OTHER PUBLICATIONS

European Search Report and Written Opinion dated Nov. 13, 2020 in priority application No. EP20181588.3; with English machine translation (total 9 pages).

* cited by examiner

*Primary Examiner* — Jack W Lavinder
(74) *Attorney, Agent, or Firm* — Seckel IP, PLLC

(57) ABSTRACT

A clasp for a wristlet has at least two movable blades (4), (5) articulated with respect to one another about an axis of the blades (51) and a locking device (10) making it possible to lock or unlock a first blade (5) relative to a second blade (4), respectively in closed and open configurations of the clasp. The locking device (10) is linked to the first blade (5) and has an actuation lever (2) intended for the actuation of the locking device by a user, a locking element (1) capable of cooperating with a complementary locking element (4*a*) of the second blade (4), and an intermediate element (3) linked to the locking element (1) by a first link device and to the actuation lever (2) by a second link device, at least one of these two link devices being provided with at least two degrees of freedom.

20 Claims, 3 Drawing Sheets

LOCKING DEVICE FOR A WRISTLET CLASP

This application claims priority of European patent application No. EP20181588.3 filed Jun. 23, 2020, the content of which is hereby incorporated by reference herein in its entirety.

INTRODUCTION

The present invention relates to a clasp for a wristlet comprising at least one locking device. It relates also to a wristlet and a wristwatch as such comprising such a clasp.

STATE OF THE ART

There are multiple solutions for hooking the two lengths of a watch wristlet around the wrist of its wearer. The first solution is simple and consists in providing the ends of each length with cooperation means, in the form, for example, of a simple loop and a tongue on the one hand cooperating with holes on the other hand. Such a solution presents the drawback that, when the cooperation means are opened, the two lengths of the wristlet are immediately separated, leading to the risk of the wristwatch being dropped.

To mitigate this drawback, another solution consists in providing an intermediate element of clasp type, disposed between the two wristlet lengths, which always remains secured to the ends of these two lengths. Such a clasp occupies two positions: a closed position, provided for the wearing of the watch, in which the wristlet and the clasp extend around the perimeter of the wrist by having an overall length allowing the wristwatch to be worn, and an open position which allows the length of the wristlet and of the clasp to be increased, by separating the two ends of the two lengths of the wristlet without detaching them from the clasp, to allow the hand to pass through the watch to be removed. In this open configuration of the clasp, the two lengths of the wristlet are not separated, which minimizes the risk of the watch being dropped.

A clasp generally comprises two or three foldable blades, which are at least partly folded back on themselves in closed position and unfolded in the open position of the clasp. Locking and unlocking mechanisms are used to guarantee that the closed position is stably maintained. For example, the document EP1654950 describes such a locking solution.

However, there is a need for another locking solution for a wristlet clasp. Thus, the invention seeks to achieve all or some of the following objects.

A first object of the invention consists in proposing a locking solution for a wristlet clasp that is reliable and robust.

A second object of the invention consists in proposing a locking solution for a wristlet clasp that has minimal bulk.

A third object of the invention consists in proposing a locking solution for a wristlet clasp that is compatible with an esthetic search for the appearance of the clasp.

BRIEF DESCRIPTION OF THE INVENTION

To this end, the invention relies on a locking device for a wristlet clasp, wherein it comprises an actuation lever intended for the actuation of the locking device by a user, a locking element capable of cooperating with a complementary hooking element and wherein it comprises an intermediate element linked on the one hand to the locking element by a first link device and linked on the other hand to the actuation lever by a second link device, at least one of these two link devices being provided with at least two degrees of freedom.

The invention is specifically defined by the claims.

BRIEF DESCRIPTION OF THE FIGURES

These objects, features and advantages of the present invention will be explained in detail in the following description of a particular embodiment given in a nonlimiting manner in relation to the attached figures in which.

To simplify the description, use will be made by convention of the terms "longitudinal direction" for the lengthwise direction of a clasp or of a wristlet length, and "transverse direction" for the right-angled direction in the plane of a clasp (more specifically, the plane of a blade or a cover of the clasp), considering in particular the closed configuration of the clasp. The vertical direction is the direction at right angles to the first two directions, oriented at right angles to the plane of the clasp (more specifically, of a blade or of a cover of the clasp).

In addition, the clasp according to the invention will be able to comprise one or two locking devices, substantially identical, arranged for example symmetrically on the clasp. Thus, the same references will be used to designate the components of the possible second locking device that are identical to the components of the first locking device, by adding the symbol to differentiate these second references from the first.

The invention relies on a clasp provided with a locking mechanism using an actuation lever arranged directly in the cover of the clasp, even on a blade of the clasp, appearing notably as a movable part of the cover of the clasp.

Such a part can for example appear as a simple cap on the cover. Such a solution makes it possible to achieve a pure esthetic appearance and a minimal bulk.

Figure 1:
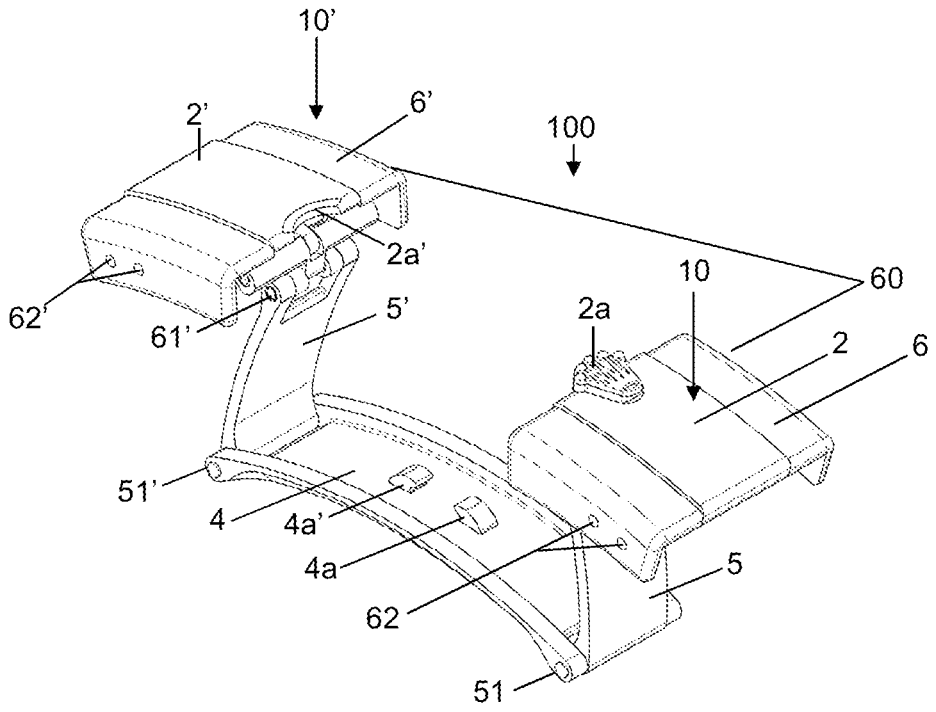
FIG. 1 represents a perspective view of a clasp that is open and partially unfolded according to an embodiment of the invention.
Figure 2:
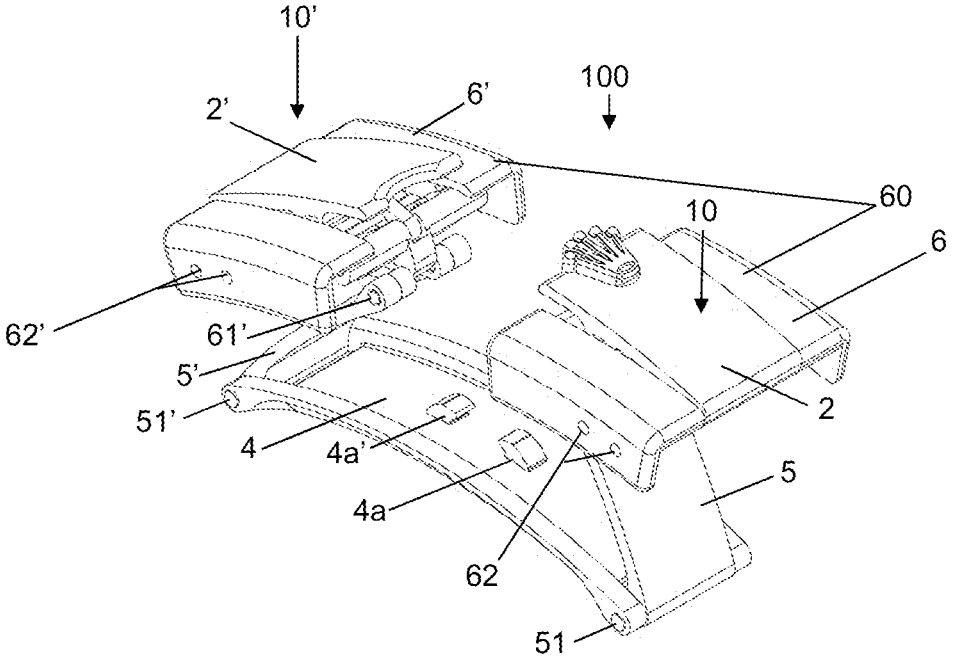
FIG. 2 represents another perspective view of the open clasp according to the embodiment of the invention.

FIGS. 1 and 2 show a clasp 100 for a wristlet according to an embodiment of the invention. This clasp 100 comprises three blades, including two lateral blades 5, 5', called first blade 5 and third blade 5', arranged symmetrically at the two longitudinal ends of a central second blade 4, respectively via transverse blade axes 51, 51'. Each lateral blade 5, 5' can occupy an open position, as represented by FIGS. 1 and 2, and a closed position in which it is folded back over the central blade 4 and locked by a locking device 10, 10' which will be described hereinbelow, to achieve a closed position of the clasp.

Figure 3:
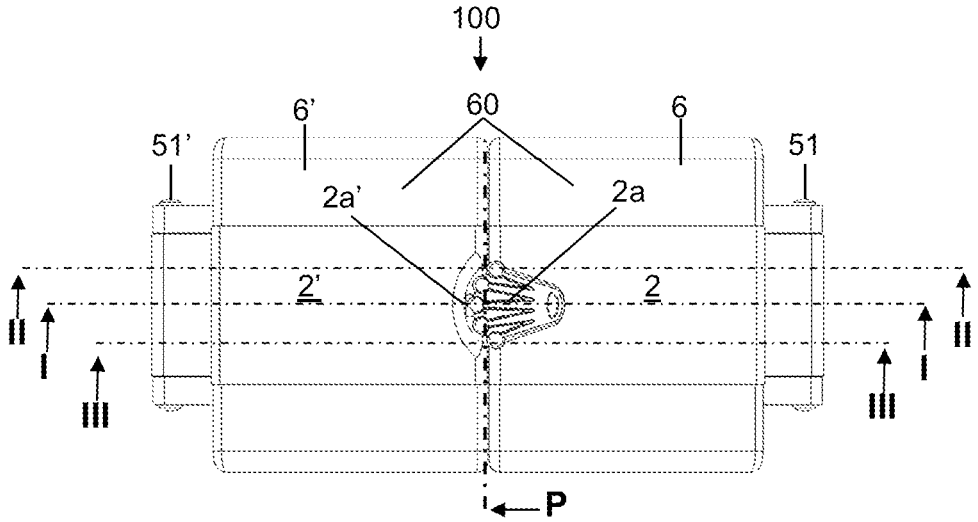
FIG. 3 represents a top view of the clasp in closed configuration according to the embodiment of the invention.

The two lateral blades 5, 5' are substantially identical and the features of just the first lateral blade 5 will therefore be described in detail. A cover 6 is fixed onto this first lateral blade 5. This cover 6 is mounted to pivot in rotation about a cover axis 61 disposed at an end of the first blade 5, opposite its end linked to the central second blade 4. The cover 6 has an inverted U-shaped cross section, having a top face that is visible to a user, and two lateral walls, substantially at right angles to the top face, intended to laterally cover all of the clasp and its mechanism, notably the locking device, to conceal it, substantially mask it, and ensure the esthetic appearance of the solution. The cover 6 also comprises, on its end opposite the cover axis 61, a fixing device for an end of a wristlet length. On the embodiment, this fixing device comprises openings 62 arranged in the lateral walls of the cover 6 in order to receive a fixing bar for a wristlet end link. In the open position, the cover 6 can therefore be unfolded relative to the blades 4, 5 of the clasp by rotation about the clasp axis 61 and contribute to increasing the length of the clasp. In the closed position, the two covers 6, 6' respectively of the two lateral blades 5, 5' come to be positioned against one another continuously, thus forming the appearance of a single cover 60 of the clasp, as represented in FIG. 3.

The locking device 10 of the first lateral blade 5 will now be described. It comprises, first of all, a locking element 1 mounted to rotate about a first axis 11. This locking element 1 comprises a form on a bottom end designed to cooperate with a complementary hooking element 4*a* arranged at the central part of the central second blade 4. According to the embodiment, this form is of hook type. As a variant, any other form allowing a mechanical locking between the locking element 1 and a complementary hooking element 4*a* is possible.

Figure 5:
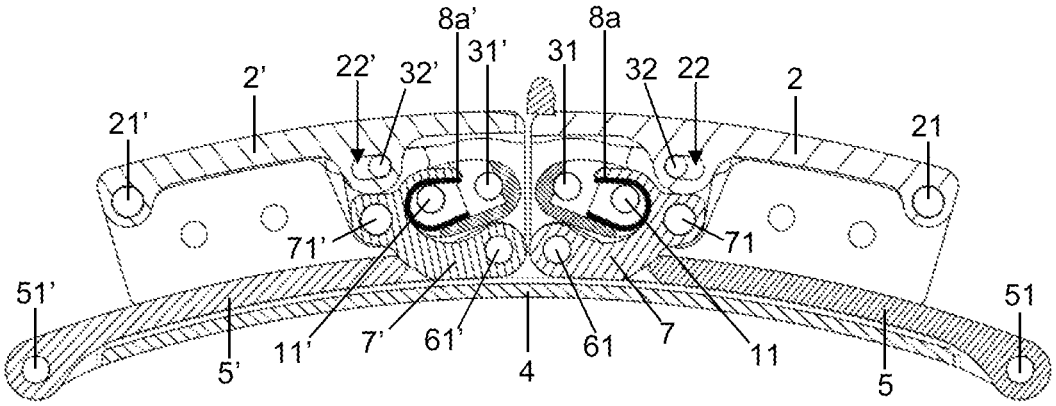
FIG. 5 represents a side view in cross section through a second vertical longitudinal plane of the clasp in closed position according to the embodiment of the invention.
Figure 6:
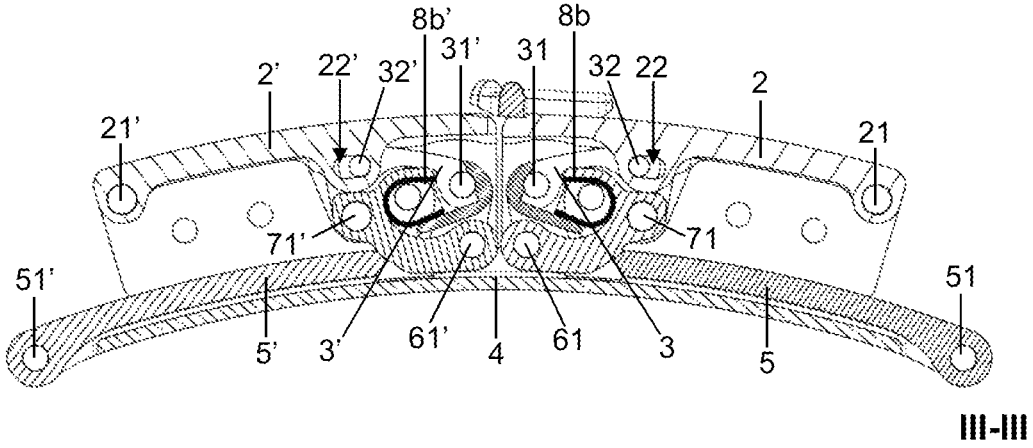
FIG. 6 represents a side view in cross section through a third vertical longitudinal plane of the clasp in closed configuration according to the embodiment of the invention.

Also, one or more return springs 8*a*, 8*b* are provided to act on the locking element 1 to tend to position it in a position capable of engaging with the hooking element 4*a* of the central second blade 4, so as to lock the wristlet clasp. In the embodiment, two springs 8*a*, 8*b* are arranged around the first axis of rotation 11, symmetrically distributed about the longitudinal median plane I-I, as is represented in FIGS. 5 and 6, respectively on the cross sections II-II and III-Ill, according to the planes represented in FIG. 3.

The locking device 10 further comprises an actuation lever 2 arranged in the cover 6. More specifically, this actuation lever 2 appears as a part of the top surface of the cover 6. It extends over the entire length of the cover 6, and is articulated in rotation about a transverse second axis 21 at the longitudinal end of the cover 6 intended to receive a wristlet end link, opposite its end intended to be positioned at the center of the clasp in the closed position.

Finally, the locking device 10 comprises an intermediate element 3, linked on the one hand to the locking element 1 by a first link device and linked on the other hand to the actuation lever 2 by a second link device.

According to the embodiment, the locking element 1 and the intermediate element 3 of the locking device are linked in relative rotation about a first intermediate axis 31. The first link device is therefore an axis of rotation. On the other hand, the actuation lever 2 and the intermediate element 3 of the locking device are linked by a second link device comprising a groove 22, arranged on the actuation lever 2, within which a second intermediate axis 32 linking the actuation lever 2 and the intermediate element 3 is displaced and about which the actuation lever 2 and the intermediate element 3 can pivot with respect to one another. Such a second link device thus makes it possible to confer two degrees of freedom between the actuation lever 2 and the intermediate element 3. Naturally, it is perfectly possible to reverse this arrangement, by configuring the groove on the intermediate element 3 and the axis on the actuation lever 2.

Figure 4:
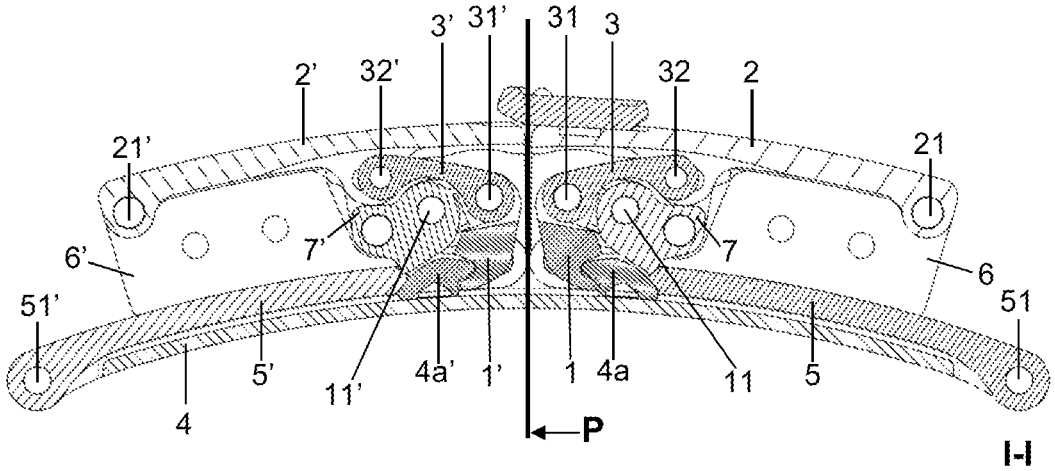
FIG. 4 represents a side view in cross section through a median vertical longitudinal plane of the clasp in closed position according to the embodiment of the invention.

In this embodiment, the first intermediate axis 31 and the second intermediate axis 32 are respectively arranged at the two longitudinal ends of the intermediate element 3. They are also positioned on either side of the first axis 11, in closed configuration of the clasp, as can be seen in FIGS. 4 and 5.

Naturally, the invention is not limited to the embodiment described. It can extend to any other solution in which at least one of said two link devices of the locking device is designed to confer two degrees of freedom on the two elements that it links. This link device can, for example, confer a first degree of freedom in rotation, and a second degree of freedom by displacement of translational type guided in a groove. This groove can extend in the longitudinal direction. As a variant, it could also have an orientation in another direction, for example vertical. The notion of "groove" should be considered in the broad sense of the term, it is not necessarily straight, and its trajectory can obviously be adapted to the kinematics of the various components of the locking device. Furthermore, according to the embodiment, the other link device confers a single degree of freedom. As a variant, it could also confer at least two degrees of freedom, like the at least one link device described above.

Thus, in a variant of the embodiment described, the first link device would therefore confer two degrees of freedom and the second link device a single degree of freedom. Furthermore, these degrees of freedom could rely on movement other than the rotations and translation described.

It should be noted that it appears, in the embodiment described, that the first axis 11, the first intermediate axis 31, the second intermediate axis 32, and the second axis 21, are distinct and parallel. They all have a transverse orientation.

The clasp according to the embodiment also comprises an element 7, particularly represented in FIGS. 4 to 6, secured to the cover 6, and fixed on the one hand to the cover axis 61 and to a parallel transverse axis 71 joining the two lateral walls of the cover. The first axis 11 of rotation of the locking element 1 of the locking device 10 is mounted to rotate on this element 7 secured to the cover 6. This element 7 also comprises recesses shaped to receive the return springs 8*a*, 8*b* around the first axis 11, in the vertical longitudinal planes II-II and III-Ill of FIGS. 5 and 6 which can be seen more particularly in FIG. 3.

The embodiment relies on the arrangement or the linking of the locking device partly on a clasp cover. As a variant, the invention can still be implemented on a clasp without cover, or whose cover and blade are combined in one and the same element. In such a case, the actuation lever 2 would be directly mounted on a movable blade instead of a cover, for example as a movable part of said movable blade. According to another variant, the actuation lever 2 can take any other form, any other part of a clasp cover. Advantageously, in the closed position, it forms a substantially continuous surface with the rest of the clasp cover.

According to the embodiment, a gripping element 2*a* is arranged on the actuation lever 2, to facilitate the actuation thereof by a user. It is more specifically arranged at the central end of the actuation lever, opposite the second axis 21.

The embodiment described relies on a clasp with three blades. As mentioned previously, each lateral blade 5, 5' can be locked onto and unlocked from the central blade 4 by a respective locking device 10, 10'. These two locking devices 10, 10' are substantially identical, symmetrically distributed relative to a vertical transverse median plane P of the clasp, represented in FIGS. 3 and 4. According to the embodiment, they differ by their gripping elements 2*a*, 2*a'* which have complementary forms to be nested together in the closed position of the clasp, these forms being thus chosen for both esthetic and ergonomic reasons. In particular, the gripping elements 2*a*, 2*a'* are shaped such that there is no order imposed in the opening and closing sequences of each lateral blade 5, 5' of the clasp 100, notably in the sequences of actuation of their respective locking devices 10, 10'. It would of course be possible to envisage shaping the gripping elements 2*a*, 2*a'* for them to be identical.

In the embodiment, it appears that the abovementioned different axes 11, 11', 21, 21', 31, 31', 32, 32', 51, 51', 61, 61', 71, 71' of the clasp are all parallel, oriented transversely. Throughout this description, the notion of "axis" relates equally to the notion of geometrical axis and to the notion of physical axis. For example, in the embodiment, the first axis 11 is an axis of rotation of the locking element 1, which can be secured or not to the locking element 1. The same applies with respect to the other axes of the embodiment, in particular the second axis 21 and the two intermediate axes 31, 32.

As a variant, it is possible to imagine other embodiments in which all or some of these axes could have other orientations. Notably, the first axis 11 and the two intermediate axes 31, 32 could be at right angles to the second axis 21. As another variant, all these axes could remain parallel, but arranged differently.

Also, in the embodiment described, the axes of the locking device are pivoting axes. Alternatively, at least one of these axes could be an axis defining a translation trajectory. For example, the actuation lever 2 could notably take the form of a component that is movable in translation relative to the cover 6, in a direction corresponding substantially to the longitudinal direction of the cover 6.

Furthermore, the clasp could, as a variant, be a clasp with only two unfolding blades, and comprising a locking device between the two blades, as described previously. In this case, the abovementioned cover 6 can then correspond to all of the cover 60 of the clasp.

The invention relates also to a wristlet, wherein it comprises a locking device as described previously or a clasp as described previously. The invention relates also to a wristwatch comprising such a wristlet.

The operation of the clasp according to the embodiment will now be explained, in relation to FIGS. 7 and 8.

Figure 7:
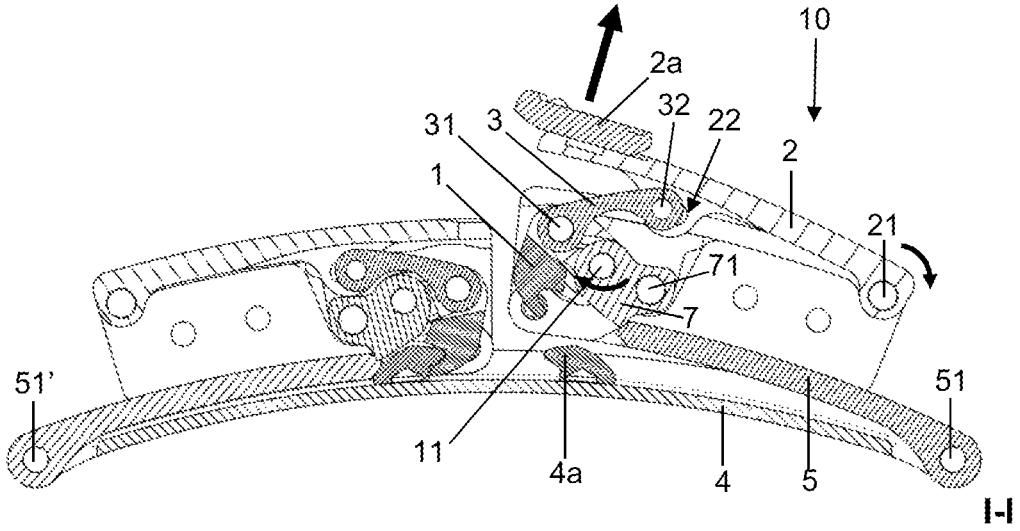
FIG. 7 represents a side view in cross section through a median vertical longitudinal plane in opening phase according to the embodiment of the invention.

FIG. 7 illustrates a cross-sectional view of the clasp on a plane I-I while the locking device 10 is actuated so as to open the clasp 100, more specifically to open the first blade 5 relative to the central second blade 4. For that, a user actuates the gripping element 2*a* to initiate a rotation of the actuation lever 2 about the second axis 21, in the clockwise direction. This actuation of the actuation lever 2 causes a rotation of the locking element 1 about the first axis 11 in the same clockwise direction, against the springs 8*a*, 8*b*. This rotation is made possible by the intermediate element 3, which allows retraction of the locking element 1 from the hooking element 4*a* of the central second blade 4, while transmitting to it the rotational movement. Note that, in this opening phase, the second intermediate axis 32 is positioned at a first longitudinal end of the groove 22, on the side of the center of the clasp.

Figure 8:
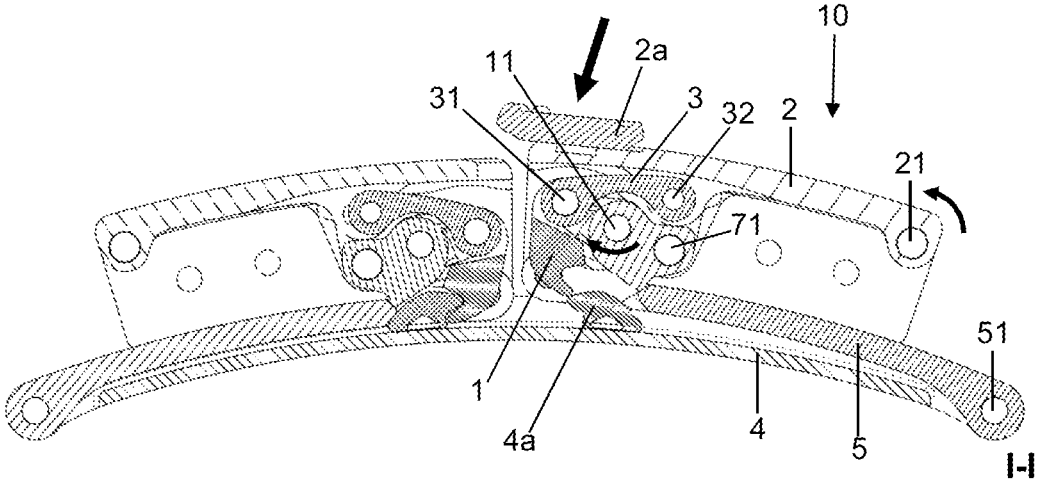
FIG. 8 represents a side view in cross section through a median vertical longitudinal plane of the clasp in closing phase according to the embodiment of the invention.

FIG. 8 illustrates the same cross-sectional view of the clasp on a plane I-I in an opposite phase of closure of the first blade 5 onto the central second blade 4. The actuation lever 2 is pivoted about the second axis 21 in the counterclockwise direction, which brings the locking element 1 into engagement with the hooking element 4*a* of the second blade 4. In this second phase, the two degrees of freedom of the intermediate element 3 relative to the actuation lever 2 are particularly advantageous because they allow a displacement of the locking element 1 relative to the complementary hooking element 4*a*, allowing it to cross the end of this hooking element 4*a*, such that the latter can be positioned under the hooking element 4*a*, to reach the final closed position represented by FIG. 4. Notably, the displacement of the second intermediate axis 32 in the groove 22 in a direction parallel or substantially parallel to the longitudinal direction of the actuation lever 2 favors this correct positioning of the locking element 1. In this closure phase, the second intermediate axis 32 is first positioned at a second longitudinal end of the groove 22, on the side of the end of the clasp, before being displaced to the opposite first longitudinal end. In other words, the arrangement of the intermediate element allows a temporary actuation of the locking element 1 by clockwise pivoting while the actuation lever 2 pivots in the counterclockwise direction on the second axis 21, allowing it to cross the end of the hooking element 4*a* and allowing it to be able to take position under this hooking element. The intermediate element 3 therefore ultimately confers on the locking element 1 a certain autonomy relative to the actuation lever 2 that is sufficient to guarantee its correct positioning in all the actuations of the actuation lever 2. By virtue of the intermediate element 3, the actuation lever 2 is notably immobile during the phase of closure of the clasp.

The invention claimed is:

1. A clasp for a wristlet, wherein the clasp comprises:

at least two movable blades articulated with respect to one another about an axis of the at least two movable blades, and a locking device making it possible to lock or unlock a first blade of the at least two movable blades relative to a second blade of the at least two movable blades, respectively in closed and open configurations of the clasp, wherein the locking device is linked to the first blade and comprises:

an actuation lever intended for actuation of the locking device by a user, a locking element capable of cooperating with a complementary hooking element of the second blade, and an intermediate element linked to the locking element by a first link device and to the actuation lever by a second link device, at least one of the first and second link devices being provided with at least two degrees of freedom.

2. The clasp for a wristlet as claimed in claim 1, wherein at least one of the first and second link devices of the locking device confers a first degree of freedom in rotation about a second intermediate axis, and a second degree of freedom according to a translation by displacement of the second intermediate axis within a groove.

3. The clasp for a wristlet as claimed in claim 2, wherein the actuation lever and the intermediate element of the locking device are linked by the second link device comprising the groove, wherein the groove is arranged on the actuation lever or the intermediate element, wherein the second intermediate axis links the actuation lever and the intermediate element, wherein the second intermediate axis can be displaced in the groove, and the actuation lever and the intermediate element can pivot relative to each other around the second intermediate axis, allowing two degrees of freedom between the actuation lever and the intermediate element.

4. The clasp for a wristlet as claimed in claim 3, wherein one of the first and second link devices of the locking device confers a single degree of freedom in rotation about a first intermediate axis.

5. The clasp for a wristlet as claimed in claim 3, wherein the locking element is mounted to be movable in rotation about a first axis, and the actuation lever is mounted to be movable in rotation about a second axis.

6. The clasp for a wristlet as claimed in claim 2, wherein one of the first and second link devices of the locking device confers a single degree of freedom in rotation about a first intermediate axis.

7. The clasp for a wristlet as claimed in claim 2, wherein the locking element is mounted to be movable in rotation about a first axis, and the actuation lever is mounted to be movable in rotation about a second axis.

8. The clasp for a wristlet as claimed in claim 1, wherein one of the first and second link devices of the locking device confers a single degree of freedom in rotation about a first intermediate axis.

9. The clasp for a wristlet as claimed in claim 1, wherein the locking element is mounted to be movable in rotation about a first axis, and the actuation lever is mounted to be movable in rotation about a second axis.

10. The clasp for a wristlet as claimed in claim 1, wherein the clasp comprises one or more return springs arranged to act on the locking element, wherein a force exerted by the one of more return spring tends to position the locking element in a position capable of being engaged with the complementary hooking element so as to lock the clasp.

11. The clasp for a wristlet as claimed in claim 1, wherein the clasp comprises a cover arranged to rotate about a cover axis on the first blade and having an inverted U-shaped section whose top face is visible to a user and whose two parallel lateral walls mask or substantially mask the locking device of the clasp, the locking element of the locking device is mounted to rotate on the first blade or on the cover about a first axis positioned at a first longitudinal end of the first blade or of the cover, and the actuation lever of the locking device is mounted to rotate on the first blade or on the cover about a second axis positioned at a second longitudinal end of the first blade or of the cover.

12. The clasp for a wristlet as claimed in claim 1, wherein the clasp comprises a cover arranged on the first blade to rotate about a cover axis, and the actuation lever is a movable part of a top face of the cover and visible to a user of the cover.

13. The clasp for a wristlet as claimed in claim 1, wherein the locking element and the intermediate element of the locking device are linked in relative rotation about a first intermediate axis.

14. The clasp for a wristlet as claimed in claim 13, wherein at least one of the first and second link devices of the locking device confers a first degree of freedom in rotation about a second intermediate axis, and a second degree of freedom according to a translation by displacement of the second intermediate axis within a groove, and the first intermediate axis and the second intermediate axis are arranged respectively at two longitudinal ends of the intermediate element, and are positioned on either side of the first axis in the closed configuration of the clasp.

15. The clasp for a wristlet as claimed in claim 13, wherein the locking element is mounted to be movable in rotation about a first axis, the actuation lever is mounted to be movable in rotation about a second axis, at least one of the first and second link devices of the locking device confers a first degree of freedom in rotation about a second intermediate axis, and a second degree of freedom according to a translation by displacement of the second intermediate axis within a groove, and the first intermediate axis, the second intermediate axis and the first axis are distinct from and parallel to one another, or the first intermediate axis, the second intermediate axis, the first axis and the second axis are distinct from and parallel to one another, or the first intermediate axis, the second intermediate axis, the first axis, the second axis and the axis of the at least two movable blades are distinct from and parallel to one another.

16. The clasp for a wristlet as claimed in claim 1, wherein the actuation lever comprises a gripping element arranged at a first longitudinal end, allowing the actuation lever to be manipulated to unlock the clasp, and the actuation lever is movable in rotation about a second axis positioned at a second longitudinal end of the actuation lever.

17. The clasp for a wristlet as claimed in claim 1, wherein the clasp is a clasp with three movable blades, comprising two blades, which are the first blade and a third blade, articulated on a central blade, which is the second blade, and two locking devices, the locking device is a first locking device of the two locking devices, and a second locking device of the two locking devices, substantially symmetrically arranged relative to the first locking device, links the third blade relative to the second blade, the first and second locking devices making it possible respectively to lock the first and third blades on the central second blade.

18. A wristlet, wherein the wristlet comprises a clasp as claimed in claim 1.

19. A wristwatch, wherein the wristwatch comprises at least one wristlet as claimed in claim 18.

20. The clasp for a wristlet as claimed in claim 1, wherein the clasp is a clasp with two movable blades, which are the first and second blade.

* * * * *